US008172696B2

(12) United States Patent
Lum

(10) Patent No.: US 8,172,696 B2
(45) Date of Patent: May 8, 2012

(54) SPORTS TRAINING DEVICE

(75) Inventor: Calvin Kwai On Lum, Simi Valley, CA (US)

(73) Assignee: Calgolf LLC, Westlake Village, CA (US)

( * ) Notice: Subject to any disclaimer, the term of this patent is extended or adjusted under 35 U.S.C. 154(b) by 0 days.

(21) Appl. No.: 13/224,952

(22) Filed: Sep. 2, 2011

(65) Prior Publication Data

US 2012/0071257 A1 Mar. 22, 2012

Related U.S. Application Data

(60) Provisional application No. 61/384,810, filed on Sep. 21, 2010.

(51) Int. Cl.
*A63B 69/36* (2006.01)

(52) U.S. Cl. ..... 473/256; 473/257; 473/409

(58) Field of Classification Search ..... 473/219, 473/226, 229, 232, 256, 457, 409
See application file for complete search history.

(56) References Cited

U.S. PATENT DOCUMENTS

| | | | | |
|---|---|---|---|---|
| 649,190 | A | 5/1900 | Zimmerman | |
| 1,091,985 | A * | 3/1914 | Thompson et al. | 473/149 |
| 3,147,976 | A | 9/1964 | Millar | |
| 3,229,980 | A * | 1/1966 | Silberman | 473/232 |
| 3,414,267 | A | 12/1968 | Engle et al. | |
| 3,428,325 | A | 2/1969 | Atkinson | |
| 3,743,297 | A | 7/1973 | Dennis | |
| 3,904,199 | A | 9/1975 | Burchett | |
| 4,253,664 | A | 3/1981 | Daulton | |
| 4,346,563 | A | 8/1982 | Hood | |
| 4,364,563 | A | 12/1982 | Stafford | |
| 4,407,503 | A * | 10/1983 | Nishizawa | 473/149 |
| 4,846,472 | A | 7/1989 | Terza | |
| 5,026,064 | A | 6/1991 | Novosel | |
| 5,180,349 | A | 1/1993 | Marcus | |
| 5,259,617 | A | 11/1993 | Soong | |
| 5,316,306 | A * | 5/1994 | Cody | 473/239 |
| 5,531,438 | A | 7/1996 | Corley | |
| 5,577,966 | A | 11/1996 | Duran | |
| 5,599,021 | A | 2/1997 | Lary et al. | |
| 5,618,039 | A | 4/1997 | Tsai et al. | |
| 5,672,118 | A | 9/1997 | Robbie | |
| 5,709,619 | A * | 1/1998 | D'Emidio | 473/424 |
| 5,807,183 | A | 9/1998 | Benson | |
| 6,458,037 | B1 | 10/2002 | Dixon, Jr. | |
| 6,974,389 | B1 | 12/2005 | Shioda | |
| 7,070,520 | B1 | 7/2006 | An | |
| 7,285,054 | B1 | 10/2007 | Morrision | |
| 7,594,858 | B2 | 9/2009 | Hauk | |
| 7,758,441 | B2 | 7/2010 | Rochford et al. | |
| 7,785,211 | B2 | 8/2010 | Hackenberg | |
| 2007/0238556 | A1 | 10/2007 | Gipple | |
| 2009/0048034 | A1 | 2/2009 | Novosel, Sr. | |
| 2009/0082124 | A1 | 3/2009 | Hackenberg | |
| 2009/0174147 | A1 | 7/2009 | Saunders | |

* cited by examiner

*Primary Examiner* — Nini Legesse
(74) *Attorney, Agent, or Firm* — Greenberg Traurig, LLP

(57) ABSTRACT

A training device for improving one's swing in a particular sport having a weighted member flexibly tethered to a handle. The handle is gripped swinging the weighted member against a target.

11 Claims, 6 Drawing Sheets

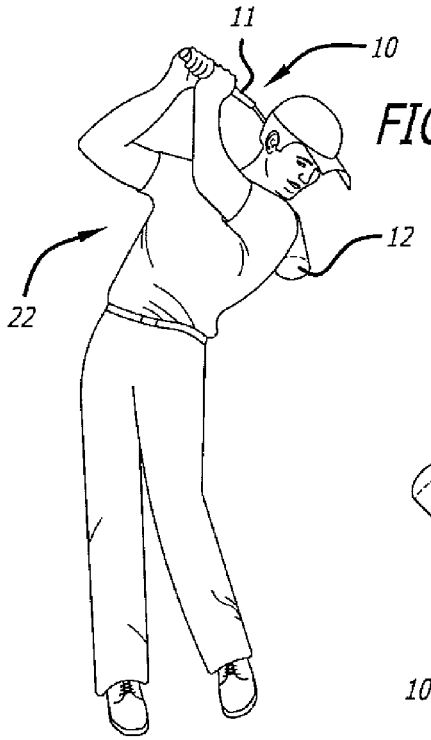
FIG. 3
FIG. 4
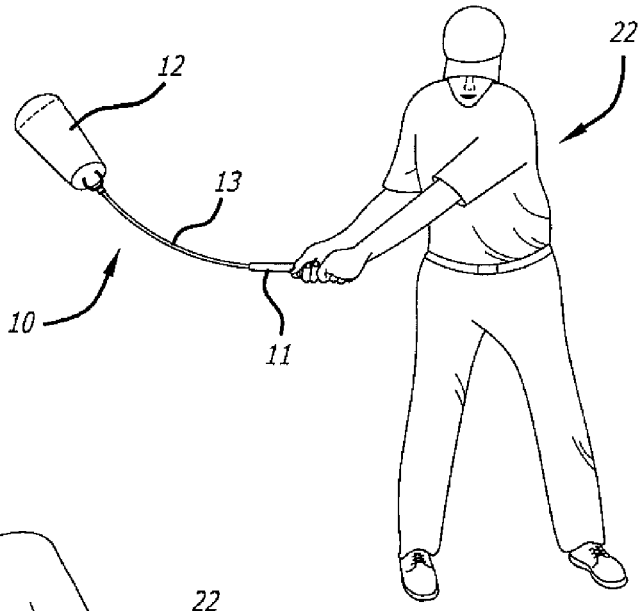
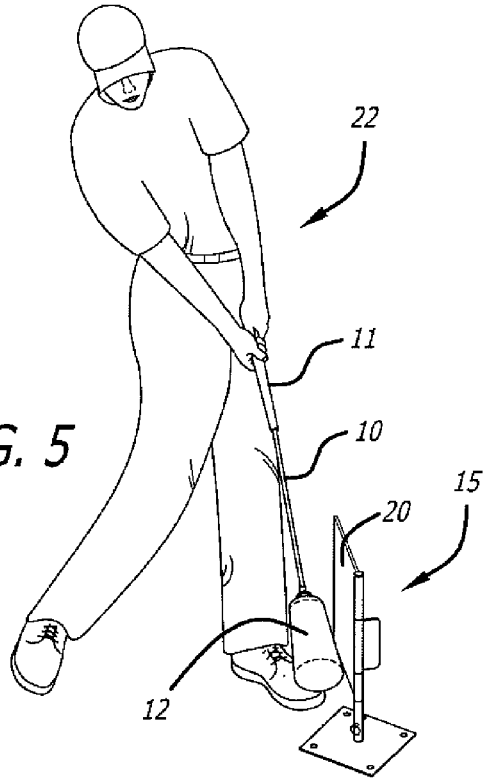
FIG. 5

FIG. 12
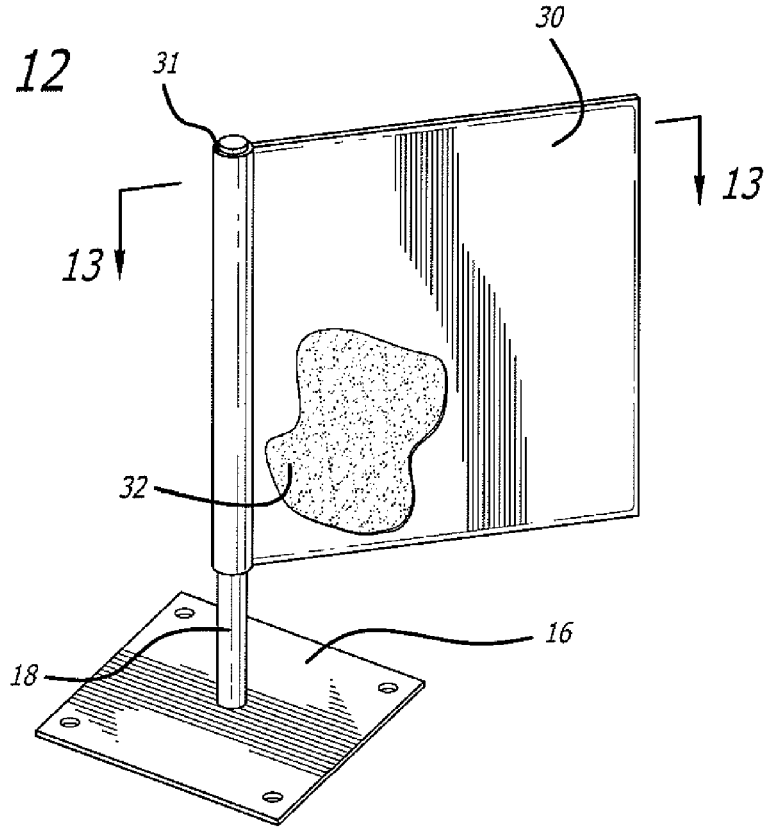
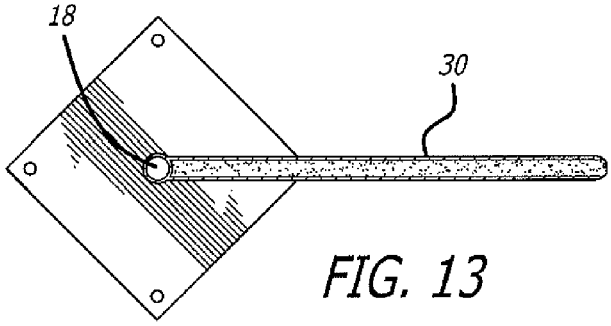
FIG. 13
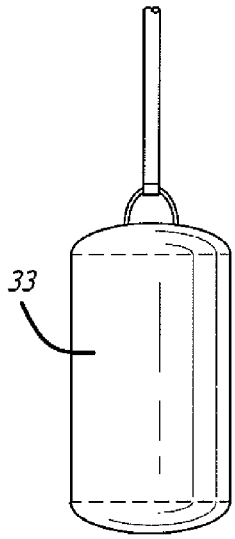
FIG. 14

SPORTS TRAINING DEVICE

RELATED APPLICATION

This application claims the benefit of and priority to U.S. Provisional Application Ser. No. 61/384,810, filed Sep. 21, 2010, the content of which is incorporated by reference herein in its entirety.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not applicable

BACKGROUND OF THE INVENTION

1. Field

The invention relates to sports training devices; and, more particularly, to a device for improving the swing of a player of a particular sport, such as golf.

2. Description of Related Art Including Information Disclosed Under 37 C.F.R. 1.97 and 1.98

Various sports such as golf, tennis, baseball, etc. rely on the swing of the participant for effectiveness in attaining excellence in such sport. This is particularly true for golf and many devices have been suggested over the years for improving one's golf swing. The rigid shaft of a golf club makes it very hard for anyone to learn to swing a golf club as it should be swung. In order to reach maximum club speed, a golfer must apply torque from initiation to impact and keep his hands in a pendulum path.

BRIEF SUMMARY OF THE INVENTION

It is an object of this invention to teach a player, such as a golfer, how to execute a real golf swing.

It is a further object of this invention to carrying out the foregoing object by teaching the player to apply a pulling force (tension) at the grip end of a club or the like to cause a pendulum effect without the use of any other type of force.

These and other objects are preferably carried out by providing a shaft or handle tethered to a weighted member by a flexible cord or the like.

A target is provided having a cushioning member engaged by the weighted member when the latter is swung against and into contact with the target.

BRIEF DESCRIPTION OF THE SEVERAL VIEWS OF THE DRAWINGS

The above-mentioned features and objects of the present disclosure will become more apparent with reference to the following description taken in conjunction with the accompanying drawings wherein like reference numerals denote like elements and in which:

FIGS. 3 to 5 illustrate the device of the invention used to practice a golf swing using the target of FIG. 2;

FIG. 12 is another modification, partly in section, of a target in accordance with the teachings of the invention;

FIG. 13 is a view of the target of FIG. 12 taken along lines 13-13 thereof; and FIG. 14 is an elevational view of a modification of the weighted member of the embodiment of FIG. 10.

DESCRIPTION OF THE PREFERRED EMBODIMENT

Figure 1A:
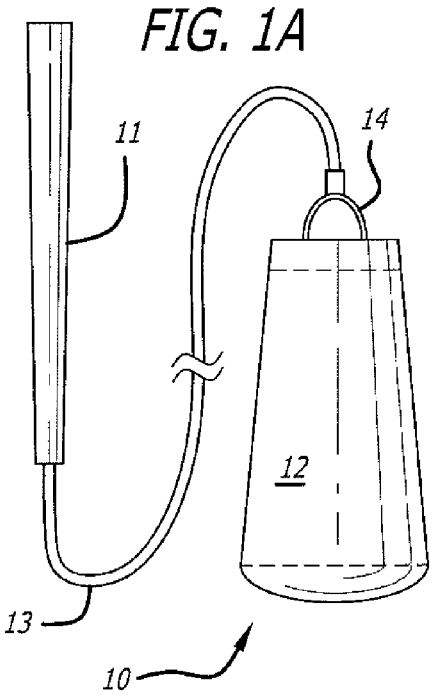
FIG. 1A is an elevational view of a sports training device in accordance with the teachings of the invention.
Figure 1B:
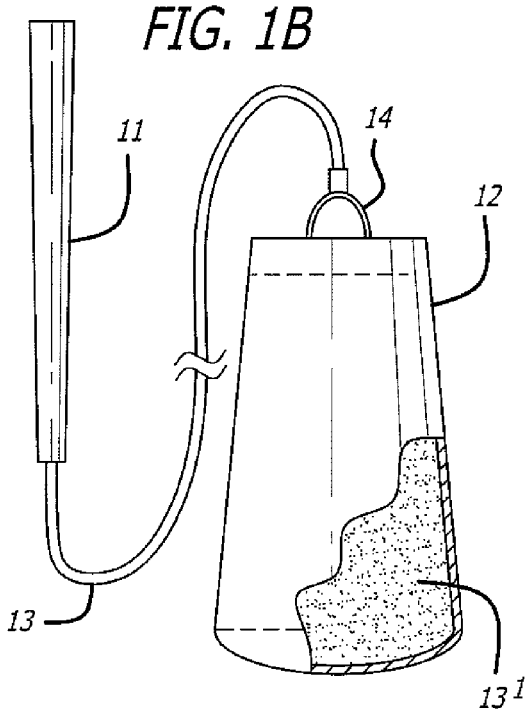
FIG. 1B is a view similar to FIG. 1A showing the interior of the weighted member in FIG. 1A.

Referring now to FIGS. 1A and 1B of the drawing, a sport training device 10 is shown having a handle 11 attached to a weighted member 12 by a tether 13. Weighted member 13 is filled internally with a cushioning material, such as cotton batting 13. Tether 13 is attached to a ring 14 integral with weighted member 12 at the top thereof. Tether 13 is a string or cord such as a nylon cord, that is comprised of a plurality of strands of threads braided, twisted or woven together.

Figure 2:
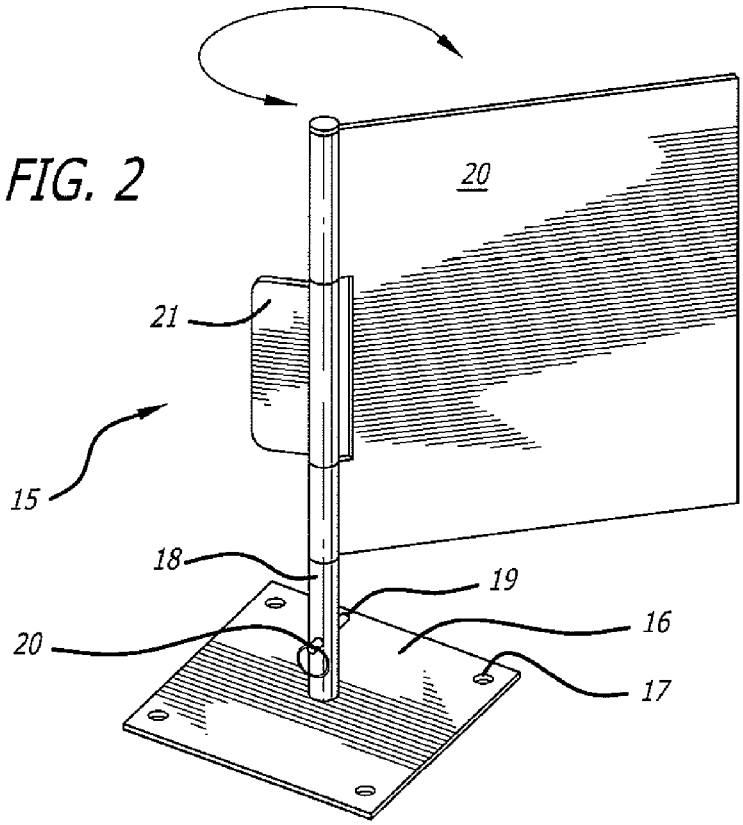
FIG. 2 is a perspective view of a target used with the device of the invention shown in FIGS. 1A and 1B.

As seen in FIG. 2, and as will be discussed further, a target 15 adapted to be used with device 10 of FIGS. 1A and 1B is shown. Target 15 is comprised of a flat base support plate 16, of metal or the like, adapted to be placed on a supporting surface. A plurality of holes 17 are provided for securing plate 16 to the supporting surface. However, in some sports, such as golf, a driving mat (not shown) may be provided having a hole therein for receiving pole 18.

Plate 16 may be disposed under such a mat with pole 18 extending upwardly therefrom. Pole 18 may be comprised of telescoping sections having a release pin 19 disposed in aligned holes in such sections for adjusting the overall height of pole 18. A strike plate 20 is swingably mounted on pole 18 by a pivot member 21 attached to plate 20 mounted on pole 18 for rotation thereof.

In operation, as seen in FIGS. 3 to 5, player 22 grasps handle 11 with weighted member 12 adjacent his shoulder (FIG. 3). Player 22 swings device 10 (FIG. 4) with weighted member 12 moving away from the player's shoulder. As seen in FIG. 5, he swings the weighted member 12 against the face of strike plate 20. The technique illustrated in FIGS. 3 to 5 will improve one's golf swing.

Figure 6:
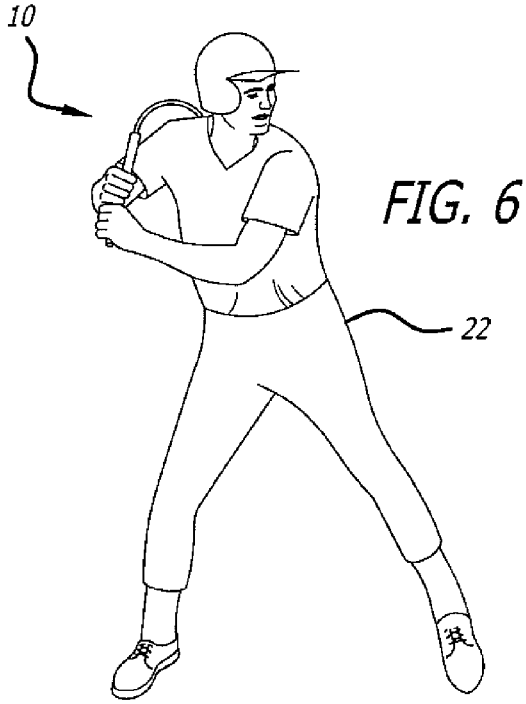
FIGS. 6 and 7 illustrate the device of the invention used to practice a batting swing.
Figure 7:
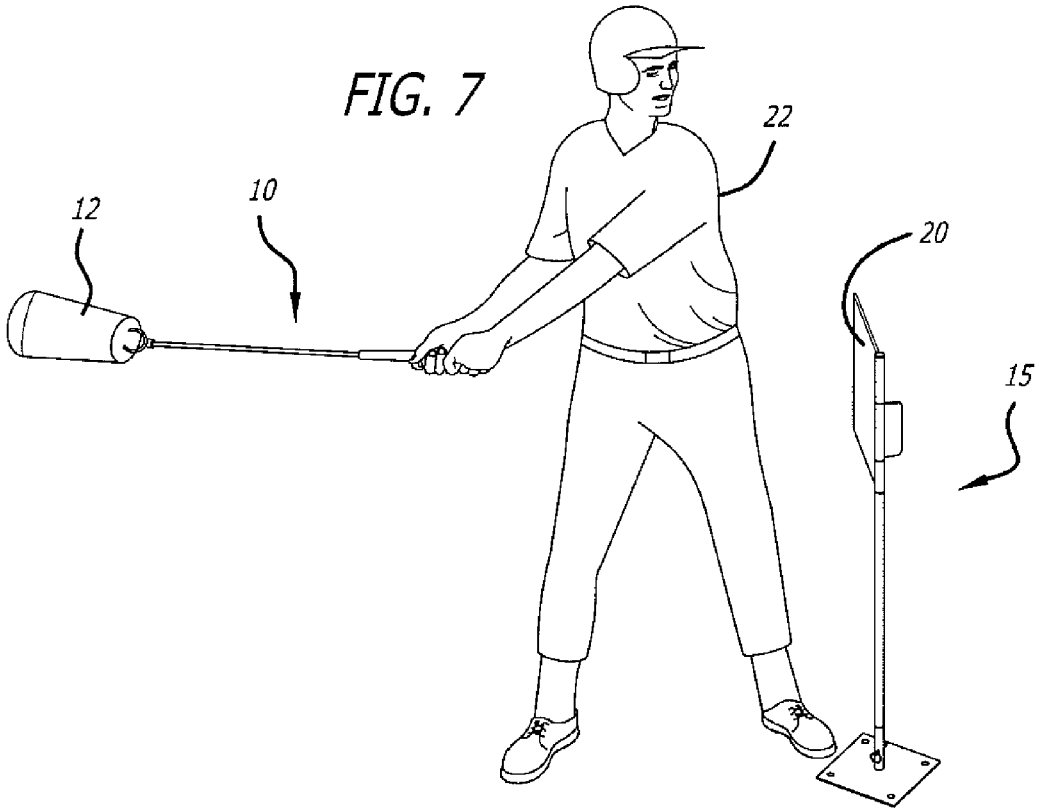

FIGS. 6 and 7 are similar, but show how device 10 can be used to swing the weighted member 12 against strike plate 20 (FIG. 7) to improve one's batting swing.

Figure 8:
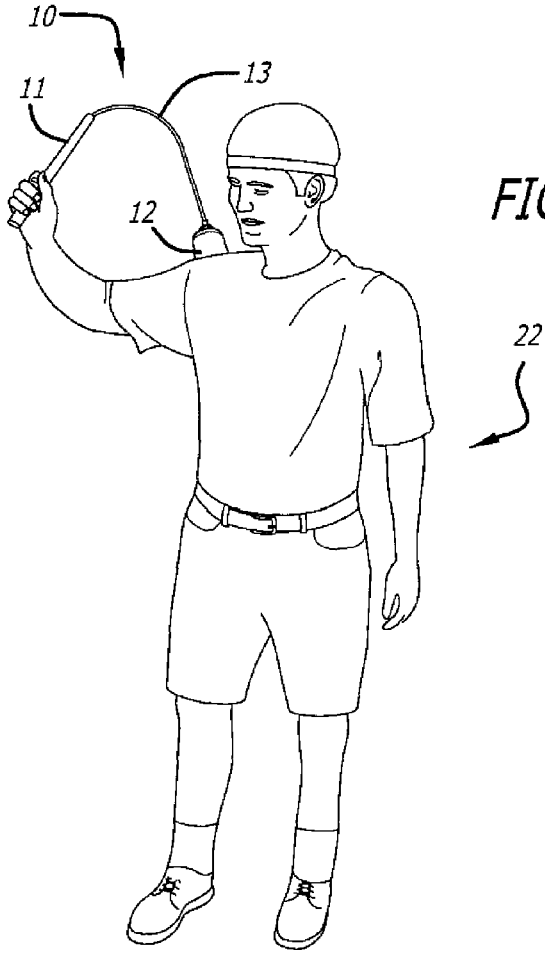
FIGS. 8 and 9 illustrate the device of the invention used to practice a tennis swing.
Figure 9:
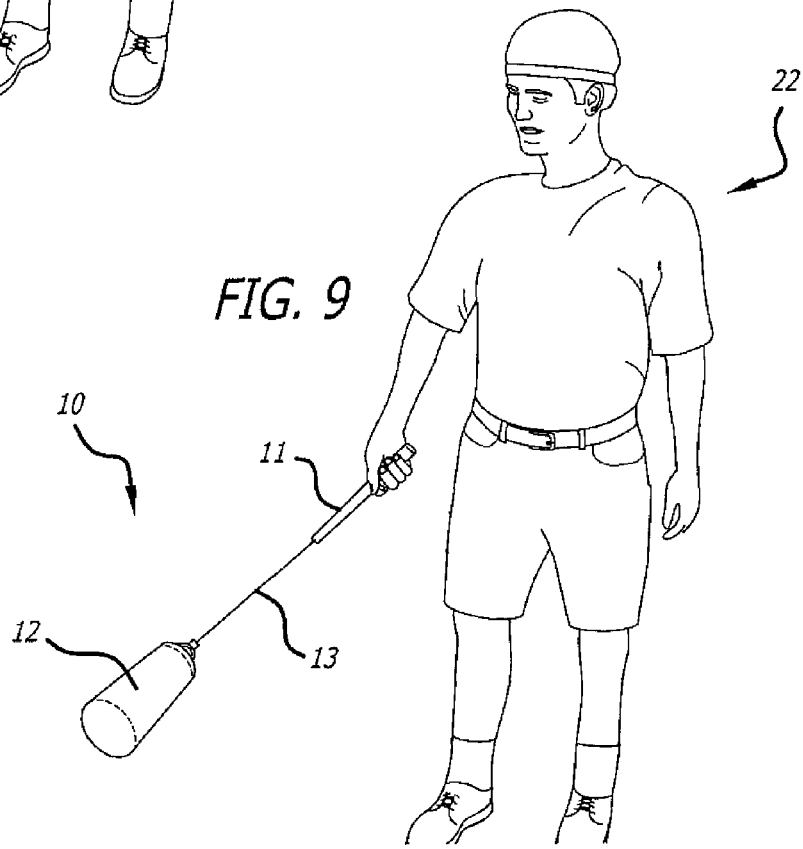

FIGS. 8 and 9 illustrate how device 10 can be used to improve one's tennis swing by swinging weighted member 12 about tether 13 from the FIG. 8 to the FIG. 9 position.

Figure 10:
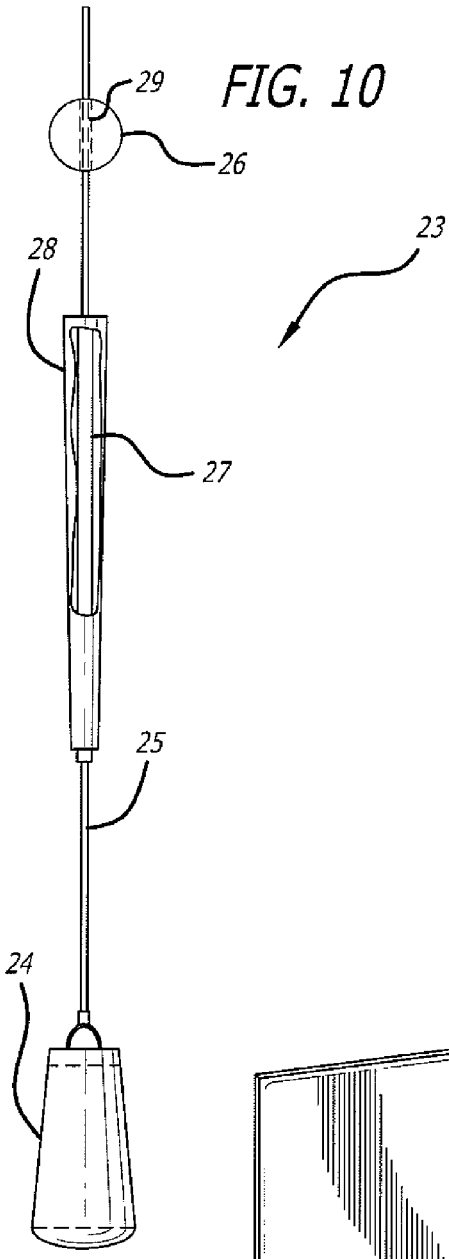
FIG. 10 is an elevational view, partly in section, showing another embodiment of the device of FIGS. 1A and 1B.

FIG. 10 is another embodiment of the invention showing a device 23 having a weighted member 24 attached in any suitable manner by a tether 25, such as a nylon cord, to a solid ball 26, such as a golf ball. Note that tether 25 passes through a portion 27 of golf shaft having a golf shaft grip 28 on the outside thereof. Tether 25 is preferable a flexible string or cord made up of plurality of fibers passing through a hole 29 in ball 26 and tied or otherwise secured thereto. Weighted member 24 is also filled with suitable material, such as cotton batting. Ball 26 controls the overall length tether 25.

Figure 11:
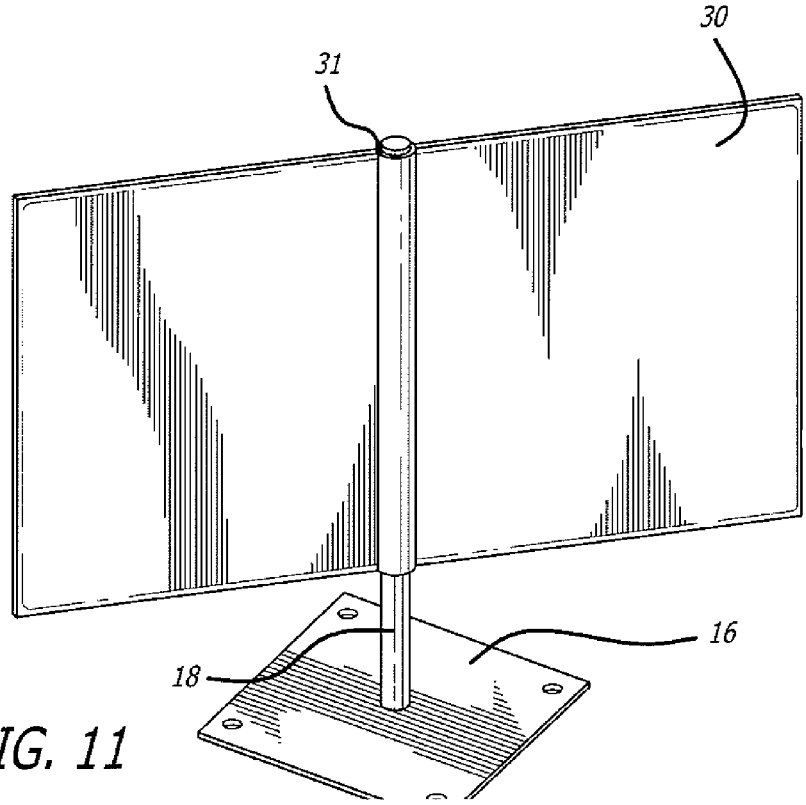
FIG. 11 is an elevational view, partly in section, showing a modification of a target in accordance with the teachings of the invention.

Although a strike plate 20 is shown in FIG. 2, a modification thereof is shown in FIGS. 11 to 13. Here, plate 16, similar to plate 16 in FIG. 2, has a pole 18, which may also be telescopingly adjustable as in FIG. 2, but, instead of a rigid metal plate, has a cushioning member 30 which may be filled with a suitable cushioning material such as cotton batting 32 (FIG. 12) mounted on pole 18. This may be accomplished by providing a hole 31 through member 30 at one end thereof (see FIG. 13), pole 18 extending therethrough (also seen in FIG. 14).

In the embodiment of FIG. 14, the cylindrical member 33 demonstrates the true mechanics of tension when it is swung against a target as in FIGS. 3 to 5. Using the grip or handle 28 of FIG. 10, one quickly notices how one's nervous system tries to apply leverage. The ball 26 acts as a slip-type retainer or buckle and also displays the feel for the transfer of momentum.

In operation, instead of swinging weighted members 12, 24 or 33, against plate 20, the weighted members 12, 24 and 33 are swung against cushioning member 30.

It can be seen that there is apparatus for reactive movements with the application of a pendulum and the relating second pendulum, like walking, throwing, striking, as in most natural movements of human body.

The object of the invention is to provide a group of apparatus for the purpose of identifying the different phases of movements which make up the actions of the different sequences very clear and understood by the nervous system.

Thus, my invention teaches someone how to execute a real golf swing by applying a pulling force (tension) at the grip end to cause a "pendulum effect" without the use of any other type of force. This is accomplished by a golfer or the like applying forces to push his club head in the direction of the target (e.g, a golf ball). A more accurate and powerful impact of the club head with the ball will be accomplished when the golfer allows the club head to free-wheel through the ball.

The foregoing is accomplished by use of a mass attached to a grip by a yielding link, such as a rope. The reality of a swinging pendulum is approached as closely as possible. By becoming more proficient with the yielding link of the invention, one's swing becomes smoother both backward and forward by establishing one's body's fixed axes, swinging one's lead arm in the same way using tension to the fixed axes to power the swing instead of pushing the following arm to the target. The swinger's following bent elbow is close to the swinger's side allowing the swinger's body to supply torque.

The overall length of the device is approximately the length of a mini iron golf club. The user swings the device by gripping handle 11 and swings the weighted member 12. The swinger's hand also not control the swing; the swinging hands create tension to pull the swinging device 10 through an arc to control one's swing.

As one swings device 10, the mass or weighted member 12, 24 or 33 falls against one's back at the swing begins to pull the "yielding link (string or rope 13) taut by settling one's lead hip to clear the path. This also makes for the extended stretch of the body just before turning into impact. One's lower body and upper torso turn in unison with the greater moment of inertia of the swinger's extended passive arm and golf club, the lower body will lead the upper body.

It can be seen that angular momentum will cause the passive hands to be pulled in front of one's body, leading the orbiting mass. It is easier to continue a motion than to start one.

Without this move, a wide sweeping ARC will occur at the top of the down swing and the club will release immediately and the large moment of inertia will slow the swing.

The hands are passively being pulled along at the same speed of the rotating upper torso. With one's hands holding on to the handle of the golf club, the club head stays in the orbit. The grip end of the club moves as fast as one's hand; due to inertia, the club head will maintain a 90° angle between the club shaft and the lead arm.

The point that one's hand approaches his following knee, the "pivot" is turned into a "power pivot," with the muscular action of the mid-upper torso. One's following hand begins to assist the catapulting lead hand to automatically increase the speed of the angular momentum of the club head.

This speed is delivered in the form of a circular path of the catapulting extended arm and not the forces from individual parts of the arm.

Once one's arms and club head are on an in-line orbit to the golf ball, moving like a gyroscope, it will act like a self regulating mechanism.

Any attempt to force the hands forward ahead of orbit impedes the natural are and timing of club head acceleration.

The device herein includes an 'impact reminder.' It can be used in one's yard or at the driving range. It can be used to find and feel one's "acceleration zone" and one's "free-wheeling zone."

Striking of the "impact reminder" is a very important part of one's learning experience.

You can't move properly, perceive properly or predict properly if you can't determine how long events last.

Precision, clarity, and power of what you perceive to represent the exact timing and incredibly controlled sequencing of movement determines one's ability to perform.

Once one's "point of impact"' is located, you will be able to organize your swing.

Most players feel this cuts their swing in half and they have also heard that they should not hit at the ball.

After a few swings the light goes on and they begin to feel that the golf swing is simpler than ever. Body turn becomes clear and deliberate. A passive arm begins to work.

All of one's efforts to accelerate the club head happens in the 'acceleration zone.' It ends before impact.

In order to strike the ball in a downward direction one's hands must be ahead of the club head at impact.

The purpose of a golf swing is to strike the ball and not to make a follow through.

The 'free-wheeling zone' starts where the 'acceleration zone' ends. Striking the 'impact reminder' will automatically stop all of the follow-through.

Any effort to try to accelerate the club head in the 'free-wheeling zone' is a waste of effort.

The 'impact reminder' will teach someone in a very natural way to release his wrist properly to allow for 'conservation of angular momentum' to happen, instead of pushing through that zone.

The acceleration of the upper pendulum will be easier and quicker when you maintains the 90° angle between the lead arm and the golf club due to a smaller moment of inertia.

the faster one swings the more angular velocity obtained for the same torque. The earlier in the down swing the release occurs, an equivalent increase in the braking torque on the arm takes place.

The 'impact reminder' will teach one in a very natural way, to deliberately accelerate the club head where it counts.

A golf club is designed to have the club head lead the shaft into impact. You do not push though the ball at impact. Pushing through at impact rearranges the conserved angular momentum that has been created.

As one continues to use the 'impact reminder,' you will begin to feel the releasing of momentum through impact as one's hands slow automatically like a self regulating mechanism.

During the down swing momentum is continuously being generated. In a swing 'free-wheeling' through impact there is a second half of the down swing, the redistribution of angular momentum towards the club head.

Angular momentum requires a pulling force to keep the momentum on a circular path. The angle at the wrist will automatically straighten at the same rate as the equivalent braking torque on the arm.

Simply catapult one's lead arm against one's upper pectoral muscles, weight posting on the left leg, head and upper body back, following shoulder coming down and through, lead arm fully extended and 'free-wheel' through the ball.

Loosening of one's lead hands weakens the forearm and elbow at impact. Steering the club head through impact with the hands going down the target line is a linear deceleration of the club head.

The device disclosed herein may be attached to a 'golf grip' which is like the one on one's golf club. Because the grip is attached to a golf club, one uses the grip to control the 'rigid shaft.' The 'mass' and the 'yielding link' will train one to use the grip correctly. All one needs to do is to keep it 'pointed at the mass,' throughout the swing.

The force applied to the handle of the golf club propagates down the length of the shaft. The handle moves first and then the part of the club closest to the handle and then a part just a bit further away until the club head moves as well. It is like a wave propagating in a string until the handle stops its forward motion.

In a simple pendulum, maximum speed would be when the shaft is in a straight line. Golf clubs are manufactured to reached maximum speed when the club head is forward of a straight line.

There are many influences on how angular momentum is generated and distributed during the golf swing.

In a swing where one strives to maintain significant acceleration/torque during impact, there will be less redistribution. Only by letting the wave propagating from the handle will redistribution take place.

Only by letting the handle and then the next closest part slow, will the redistribution of angular momentum speed up the furthest point which is the club head.

the golfer using the device herein will eliminate unnecessary moves and allow the alignment of the club head path and direction to become the greater part of the golf-swing.

The target is not an impact bag but rather a "Swing-Through Reminder' that allows one to feel the 'free-wheeling' follow-through of one's golf swing. The user will begin to learn what really happens after striking the ball, the follow through of one's body, arms and club head.

One begins to feel the generation of speed and the precise timing of the whipping through impact, that is released earlier and not at impact.

The whole swing sequence is a continuous motion. The whole swing sequence is a deliberate and well throughout motion.

After impact with the 'Swing-Through Reminder,' the strike plate will return to its original position. This will allow one to maintain most of one's structure, since you don't have to bend to replace it. This gives one the opportunity to really use it as a learning tool. Use each swing's feedback as a feed-forward to perfect one's ability to make deliberate movements, until you are able to make every motion deliberately and not a chaotic whim.

Balanced throughout the entire swing allows deliberately delivers speed and accuracy.

Like a professional baseball player who just hit a home run, one can see how balanced he is as the follow through of his swing seem to flow along with his turning body. Sometimes one releases their following hand and allow the lead arm to 'free-wheel.'

There is no fast abrupt finish, but rather, one where the arms are orbiting at the same speed as the body until the bat's momentum carries the bat beyond the hands.

The device herein is pulled 'taut', 'free-wheeling' through impact while maintaining this in line set up through follow-through like the home run hitter is at the conclusion of the 'perfect path of an orbiting mass on a yielding link.'

With one's knees bent and body tilted forward, one makes a back swing using a whole body turn where one's hips are at least 45° and one's shoulder turned 90°.

As device 10 is about to wrap around one's back, you down-swing with your feet, legs and hips, which will begin your shoulder turning and the passive arm will drag the device into orbit.

It is easier to continue a motion than to start one.

One's axis becomes fixed as gravity and one's body orbits one's hand and one's hand pulls the device 10 until one's hand reaches the following leg.

Here you will catapult and speed the swing; i.e., more angular velocity for the same torque and the release occurs with an equivalent increase in the braking torque on the arm.

One's lead arm against your upper pectoral muscle maintains one's structure. One's lead hand will pass the golf ball and the lead shoulder will pull your lead arm away from the ball as your following arm is pulled by your lead hand into the ball.

With your upper body back and posting on your lead leg, you 'free wheel' through the golf ball.

All of the work is done in the 'acceleration zone.' From there on the 'momentum of the club' will be the 'driving force,' 'free-wheeling' and the ball all the way to a 'compliant' finish of the 'swing.'

While the apparatus and method have been described in terms of what are presently considered to be the most practical and preferred embodiments, it is to be understood that the disclosure need not be limited to the disclosed embodiments. It is intended to cover various modifications and similar arrangements included within the spirit and scope of the claims, the scope of which should be accorded the broadest interpretation so as to encompass all such modifications and similar structures. The present disclosure includes any and all embodiments of the following claims.

The invention claimed is:

1. A training device comprising a target, a flexible non-elastic elongated member having a handle at one end and a weighted member at the other end for use in training of one's swing in differing sports, said target being mounted on a support plate having a target member mounted thereon adapted to be engaged by said weighted member when said weighted member is swung on said flexible member and into contact said target member, said target member being mounted on a pole fixed to said plate and extending vertically upwardly therefrom, said flexible member having a solid weighted ball fixed at one end extending through said handle and coupled at the other end to said weighted member.

2. The device of claim 1 wherein said device is used in training for golf.

3. The device of claim 1 wherein said solid weighted ball is a golf ball.

4. The device of claim 3 wherein said handle is a golf shaft grip tapering from a first diameter at one end adjacent said golf ball to a second diameter greater than said first diameter at said weighted member.

5. The device of claim 4 wherein said weighted member is generally cylindrical in configuration.

6. The device of claim 5 wherein said flexible member is a nylon cord.

7. A method for teaching a player how to improve one's swing in golf comprising the steps of:

providing a handle having a flexible non-elastic tether connected at one and having a weighted member connected at the other end of said tether;

providing an upstanding target mounted on a vertical shaft connected to a base support plate;

grasping said handle and swinging said weighted member around the back of said player; and subsequently swinging said weighted member on said flexible tether away from the back of said player and into contact with said target.

8. The method of claim 7 including the step of providing a cushioning member on said target.

9. The device of claim 1 wherein the height of said target member is adjustable on said pole.

10. The device of claim 1 wherein said target member is a rigid plate.

11. The device of claim 1 wherein said target member is cushioned.

* * * * *